US010308420B2

(12) United States Patent
Speck

(10) Patent No.: US 10,308,420 B2
(45) Date of Patent: Jun. 4, 2019

(54) FILLING HEAD INJECTOR FOR AEROSOL CAN WITH PROTECTIVE COVER

(71) Applicant: PRO FORM PRODUCTS LIMITED, Ontario (CA)

(72) Inventor: James H. Speck, Ontario (CA)

(73) Assignee: Pro Form Products Ltd., Milton, Ontario (CA)

( * ) Notice: Subject to any disclaimer, the term of this patent is extended or adjusted under 35 U.S.C. 154(b) by 299 days.

(21) Appl. No.: 15/304,759

(22) PCT Filed: Apr. 18, 2014

(86) PCT No.: PCT/IB2014/001728
§ 371 (c)(1),
(2) Date: Oct. 17, 2016

(87) PCT Pub. No.: WO2015/159117
PCT Pub. Date: Oct. 22, 2015

(65) Prior Publication Data

US 2017/0043940 A1 Feb. 16, 2017

(51) Int. Cl.
*B65D 83/42* (2006.01)
*B65B 31/00* (2006.01)
*B65B 39/02* (2006.01)

(52) U.S. Cl.
CPC ..... *B65D 83/425* (2013.01); *B65B 31/003* (2013.01); *B65B 39/02* (2013.01)

(58) Field of Classification Search
CPC ..... B65D 83/425; B65B 31/003; B65B 39/02
USPC ..... 141/3, 20, 27, 95, 97, 360
See application file for complete search history.

(56) References Cited

U.S. PATENT DOCUMENTS 3,338,022 A * 8/1967 Moonan ..... B65B 31/003 141/20
3,604,477 A * 9/1971 Grothoff ..... B65B 31/003 141/20
3,797,534 A 3/1974 Skidmore
5,535,790 A * 7/1996 Hirz ..... B65B 3/12 141/20
5,647,408 A * 7/1997 Erste ..... B65B 31/003 141/20
5,740,841 A * 4/1998 Hirz ..... B65B 3/12 141/20
5,832,965 A * 11/1998 Fasse ..... B65B 3/12 141/20
6,050,310 A * 4/2000 Trigiani ..... F16N 37/02 141/18
6,138,720 A * 10/2000 Zeigler ..... B65B 31/003 141/18

(Continued)

FOREIGN PATENT DOCUMENTS

CA 2 615 672 1/2016

*Primary Examiner* — Timothy L Maust
(74) *Attorney, Agent, or Firm* — Fay Sharpe LLP; James E. Scarbrough

(57) ABSTRACT

A filling head gun assembly has a housing; a handle assembly connected to the housing; a filling head attached to the housing; and a plunger. The plunger extends through an opening of the housing and an activator reservoir attached to the plunger. The reservoir is moved into position to contact the filling head via the plunger to feed pressurized activator through the filling head to an aerosol can. A cover is releasably attached to an end of the filling head which provides a seal around the filling head.

16 Claims, 11 Drawing Sheets

(56) References Cited

U.S. PATENT DOCUMENTS

| | | | | |
|---|---|---|---|---|
| 7,073,691 | B2 | 7/2006 | Rumrill et al. | |
| 7,252,119 | B2 * | 8/2007 | Heatley | B65B 3/12 141/20 |
| 8,469,063 | B2 * | 6/2013 | Speck | B65B 31/003 141/20 |
| 2006/0151050 | A1 | 7/2006 | Heatley | |

* cited by examiner

FILLING HEAD INJECTOR FOR AEROSOL CAN WITH PROTECTIVE COVER

BACKGROUND OF THE DISCLOSURE

The present disclosure relates to the art of filling pressurized containers. It finds particular application in conjunction with manually injecting activators into aerosol cans which have been previously charged with liquefied propellants and filled with paints, adhesives, resins or coatings and will be described with particular reference thereto. It is to be appreciated, however, that the present disclosure may also find application in conjunction with injecting other coating systems, including, but not limited to lubricants, fiberglass resins, SMC resins, adhesives, epoxy, urethane adhesives, and any other products which can be catalyzed or activated and dispensed from aerosol cans.

There are two common methods for filling an aerosol container with propellant, namely, the "under the cup" method which lifts the valve mounting cup and the "pressure filling" method.

More and more, the aerosol industry is resorting to "pressure filling" of the container with propellant rather than "under the cup" or out of the valve cup filling. The reasons are to diminish the loss of costly propellants and to minimize emissions of propellant into the atmosphere. In under the cup filling, a filling head actually lifts the valve cup partially out of the aerosol container and the propellant is driven under pressure through the opening between the bead (opening) of the container and the channel or circular skirt of the valve cup. In pressure filling, after product is placed in the aerosol can, the valve is crimped onto a one-inch diameter opening of the can. Then, propellant is charged into the can through the valve.

Pneumatically operated and hand operated machines have been available for some time for injecting paint and other coatings into precharged aerosol cans. For example, as illustrated in U.S. Pat. No. 3,797,534, such devices commonly included a manual lever for lifting an aerosol can to be charged into contact with a relatively small reservoir, e.g., one quart. A pneumatically operated piston drives the paint from a cylinder at the bottom of the reservoir through the aerosol valve into the can. Another example of an aerosol filling machine is the Omni-Fill® Pump owned by Sherwin-Williams.

Another example of an aerosol can filling machine is the Z-1000 Filling Machine of Seymour of Sycamore, Ill. The machine can include a manual lever and a bottle containing activator. The Z-1000 fills tints, pigments, gel coats and base coats into Seymour's pre-charged cans. The Z-1000 is a manually operated pump which adds reducers, catalysts, and hardeners to an aerosol can already filled with paint or coating, propellant and solvent. The filling machine adds activator into a bottle, which then pumps the activator into the aerosol can. A problem with this system is that the pump used does not generate enough pressure to easily pump the activator through the valve of the can. The pumping system also can have leaks.

A disadvantage of using filling machines such as those described is the machines are not typically portable and the filling process must occur at the machine location rather than in the field. Another disadvantage is that the filling machines are expensive.

Still another disadvantage of a filling pump is that it is difficult to provide sufficient pressure to inject the activator into the valve of the aerosol can.

Another disadvantage of these methods is that they do not provide a means of protecting the user when the filling head is mounted to the aerosol can or of preventing spray from spreading beyond the aerosol can.

Another disadvantage of the existing filling pumps is they do not provide a means of easily retracting the piston once fully inserted.

The present disclosure provides a new and improved portable aerosol can filling gun which overcomes the above-referenced deficiencies of the prior systems while providing more advantageous overall results.

SUMMARY OF THE DISCLOSURE

The present disclosure provides a filling gun which is used to add an activator to the aerosol can. The present disclosure relates to a filling gun assembly, similar in configuration to a caulking gun, which is used to manually inject an activator into an aerosol can without installing the can onto a pneumatic or manually operated aerosol can filling machine. The gun is inexpensive, portable, lightweight, easy to use, and can be easily transported to and used in machine shops, plants, body shops, etc. In contrast, a filling machine is typically not portable and is expensive.

In accordance with one aspect of the disclosure, a filling head gun has a housing, a handle assembly connected to the housing, and a filling head attached to the housing; wherein a plunger extends through an opening of the housing and an opening of an activator reservoir attached to the plunger. The reservoir is moved into position via the plunger to feed activator through the filling head to an aerosol can. A protective cover is provided on the filling head to protect the user and contain the spray.

In accordance with another aspect of the disclosure, a filling head and aerosol can assembly has: an aerosol can having a valve and dip tube, propellant, a coating, and a body; a filling head assembly comprising: a housing; a handle connected to said housing; a filling head attached to said housing via a piston rod; a tube containing activator which is connected to said piston rod wherein said handle is depressed to move said piston rod to feed activator through said tube into said filling head; and wherein said filling head is mounted onto said mounting cup, and a stem of said filling head seals on said valve mounting cup of said aerosol can. The filling head further has a protective cover for protecting the user and containing the spray. A platform extension is provided to aid retraction of the piston once it is fully inserted.

A method of filling pressurized aerosol can, includes removing a spray head from the can; mounting a filling head of a filling head gun to a valve assembly of the can; sealing a valve mounting cup of the can with a stem of the filling head; pushing on the valve assembly of the can; pushing a pressurized reservoir of activator into contact with the filling head, releasing activator into the aerosol can through the stem of the fill head into the valve assembly of the can.

One aspect of the filling gun is that it is portable and can be readily used in the field. Another aspect of the filling gun is that it is inexpensive. Yet another advantage of the filling gun is that it allows the mixing of a coating and activator at the time of use, this preventing curing of the coating in the can.

Another aspect of the filling gun is that it provides sufficient thrust pressure to inject activator into the valve of the can.

Still another aspect of the filling gun is that it can be adapted to be used with female or male valves or any valve system.

Still another aspect of the disclosure is a protective cap or cover which is mounted on the filling head to protect the user and prevent excess spray.

Still another aspect of the disclosure is a platform extension which aids in retraction of the piston once it is fully impressed.

Still further aspects of the present disclosure will become apparent upon reading and understanding the following detailed description of the preferred embodiments.

BRIEF DESCRIPTION OF THE DRAWINGS

The disclosure may take form in various parts and arrangements of parts. The drawings are only for purposes of illustrating a preferred embodiment and are not to be construed as limiting the disclosure.

DETAILED DESCRIPTION OF THE PREFERRED EMBODIMENT

Figure 1:
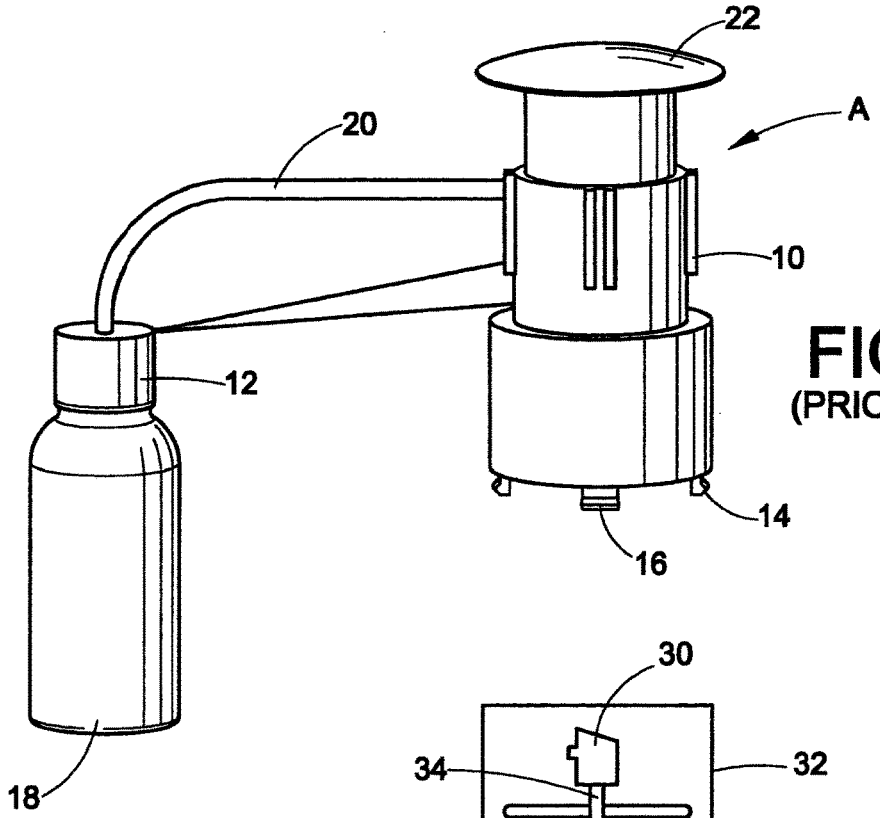
FIG. 1 (PRIOR ART)
FIG. 1 is a side elevational view of an existing aerosol can filling pump.

Referring to FIG. 1, the use of an existing manual spray pump A in an aerosol can includes the following steps: First, the spray head is removed from the aerosol can. Then, a washer 10 is removed from the side of the pump and inserted into the bottle flange 12. A collar lock 14 is turned counterclockwise to expose prongs 16, which are snapped onto the top of the aerosol can. While the pump assembly is held in one hand, the lock collar is turned clockwise with the other hand to lower the pump onto the can. The collar is tightened snugly. The bottle 18 is filled with a reducer, catalyst or hardener and screwed into the bottle flange. A dip tube 20 has a length which is adjusted so that it is touching the bottom of the bottle. The can is placed on a hard surface. The plunger 22 is firmly pressed down to pump the material from the bottle into the aerosol can. The material in the bottle is sucked into the dip tube on the upward stroke and is pushed into the aerosol can on the downward stroke. The appropriate amount of catalyst is pumped into the can plus one extra pump, which allows for the catalyst in the dip tube that never gets mixed in with the paint. Each bottle holds about 1.5 or 2 fluid ounces and each stroke is about a quarter of an ounce. The catalyzed paint must be used within 20 hours of pumping the catalyst into the can.

Figure 2:
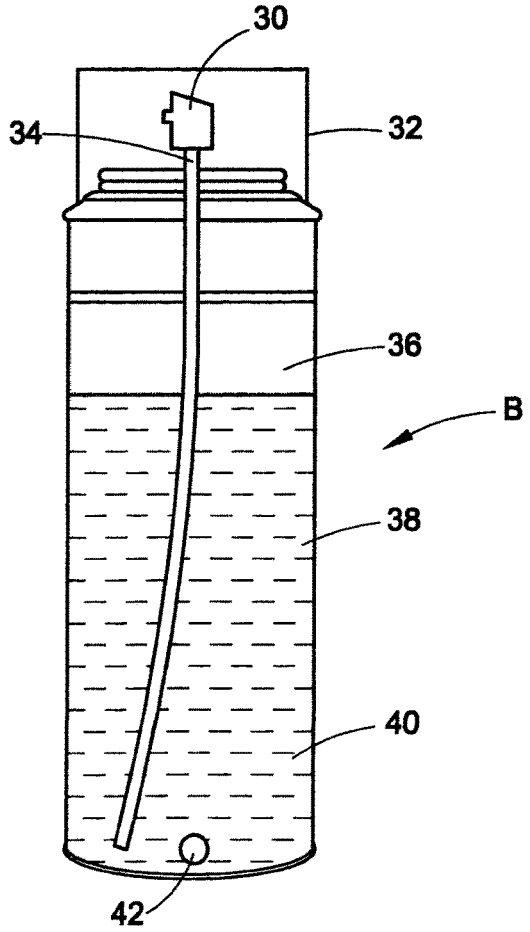
FIG. 2 is side elevational view illustrating an aerosol can.

Referring now to FIG. 2, an aerosol can B typically has seven main components: a sprayhead (actuator) 30; a cap 32; a valve and dip tube 34; propellant 36; product or coating 38 such as paint, a gel, an adhesive or an epoxy; a can body 40 and a mixing ball 42 (which rattles when shaken). The propellant drives the product or coating out through the valve at the top of the can at a pressure of about 50 to 60 lbs. Aerosol cans are typically supplied in 4-ounce, 6-ounce, 8-ounce, 12-ounce, 16-ounce, 20-ounce, 24-ounce and 32-ounce sizes.

Figure 3:
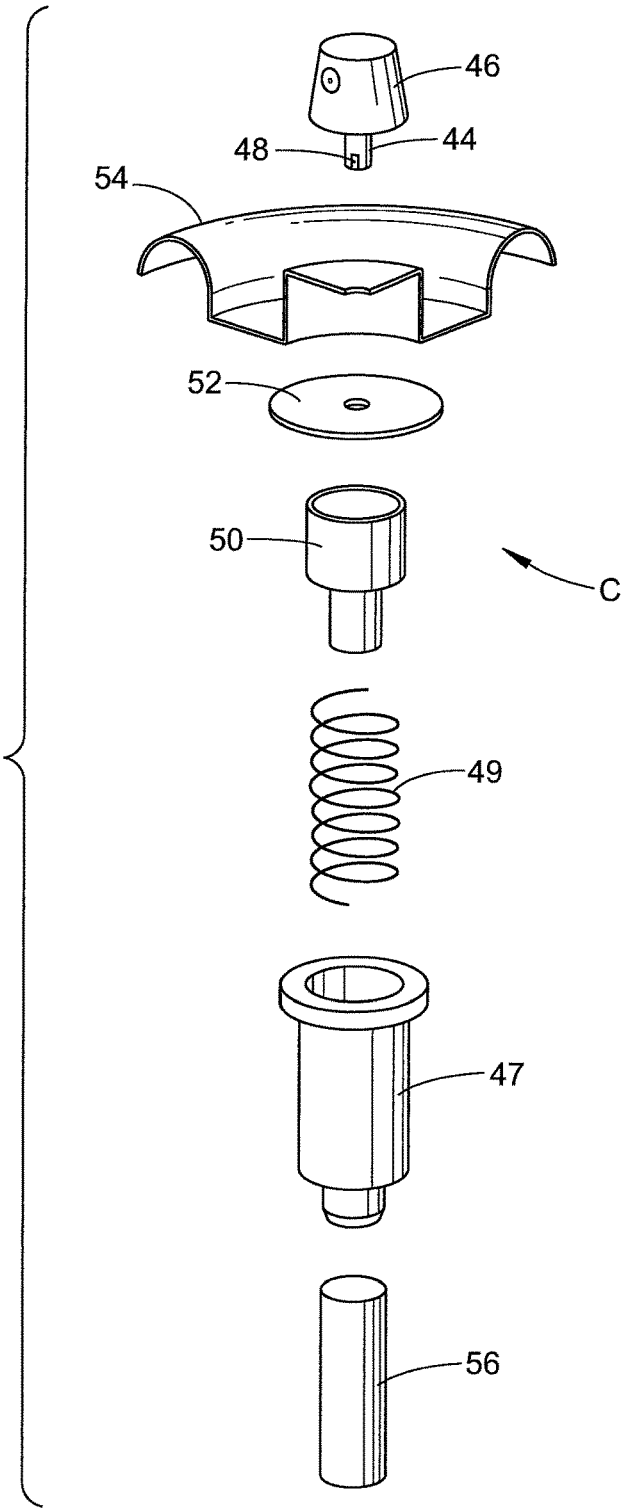
FIG. 3 is an exploded view of a female aerosol valve assembly.

Referring now to FIG. 3, a female valve assembly C is the valve often used with paints, adhesives and resins. This type of valve is used because the sprayhead can be easily removed and cleaned. The stem 44 on the female valve is located on the sprayhead or actuator 46 and the metering slot 48 on the stem determines the amount of product that is sprayed. To clean the sprayhead, a pin or knife is used on the slot at the base of the sprayhead. Once the blockage is cleared, the sprayhead can be placed back into the valve and used again. The sprayhead is placed into position with a twist and push action.

In the usual aerosol can or container, product and propellant are placed in a valved container. Referring still to FIG. 3, a valve body 47, a spring 49, a spring cup 50, a gasket 52, and a mounting cup 54 and dip tube 56 together form the valve assembly and are all crimped onto the top opening of an aerosol can. The opening is typically one inch in diameter. The valve stem 44 emerges through the pedestal portion of the container closure or mounting cup 54. The actuator 46 is frictionally fitted to the valve stem; the actuator being the component that receives manual pressure from the user of the aerosol container to actuate or open the valve and, thereby, to cause egress of the container contents. The spring head or activator is depressed which in turn causes the container contents to exit the can.

Figure 4:
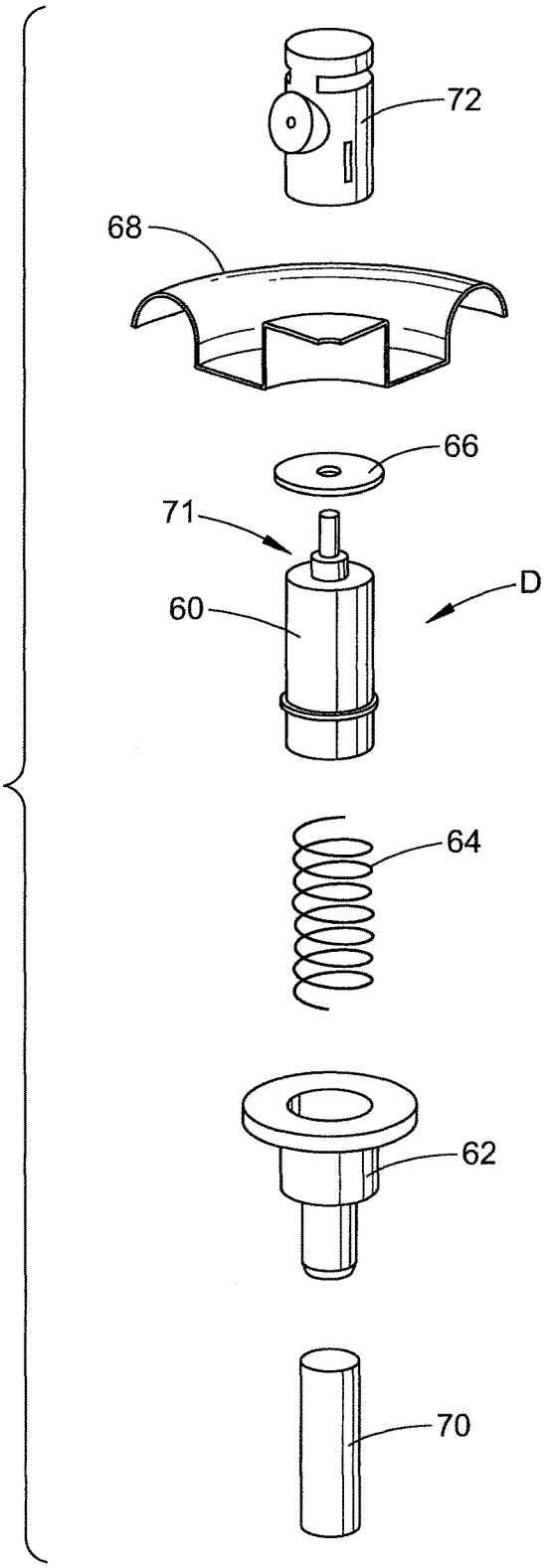
FIG. 4 is an exploded view of a male aerosol valve assembly.

Referring now to FIG. 4, a male valve assembly D is shown. The male valve also has a stem 60, a valve body 62, a spring 64, a gasket 66, and a mounting cup 68 and dip tube 70 which are all crimped onto a can. However, the metering slot 71 for a male valve is located on the stem of the valve itself. That is, the male sprayhead 72 does not have a stem. To clean the male valve, a thin knife is used to clear the blockage. The sprayhead is cleaned and reattached.

Figure 5:
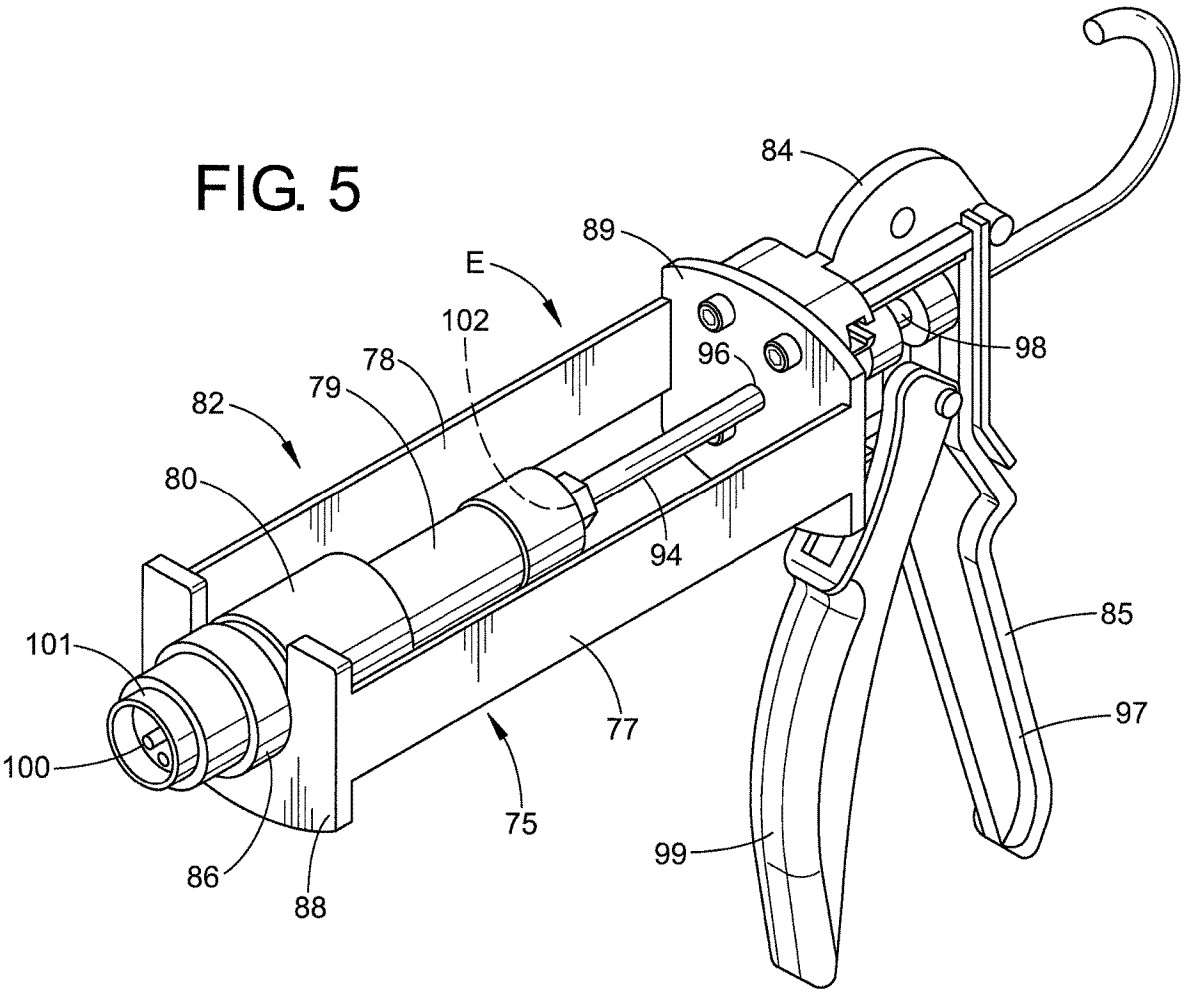
FIG. 5 is a perspective view of an aerosol can filling gun in accordance with one embodiment of the present disclosure.

With reference now to FIG. 5, the filling gun E for charging pressurized aerosol cans in accordance with a preferred embodiment is shown.

The present disclosure relates to a filling gun assembly E, similar in configuration to a caulking gun, which is used to inject an activator into an aerosol can B shown in FIG. 2 without installing the can onto a pneumatic or manually operated aerosol can filling machine. The gun is inexpensive, portable, lightweight, easy to use, and can be easily transported to and used in machine shops, plants, body shops, etc. The gun is configured similar to a caulking gun, as described for example in U.S. Pat. No. 7,073,691.

The gun is preferably used with a two-component system, wherein the can contains two components; i.e., a clear liquid or coating or paint, as well as a solvent and propellant. The coating can be a clear or color paint, base coat, clear or gel coat, or an adhesive, resin or epoxy. The gun is used as part of a two-part process, where activator is filled into or added to an aerosol can by the gun which is filled with a paint, adhesive coating, aerosol spray, epoxy, etc. in a mixing ratio such as 4:1, 1:1 or 2:1. For example, a 4-ounce product may require 1 ounce of activator; thus, the mixing ratio is 4:1. For 8 ounces of product, 4 ounces of activator may be required, or a 2:1 mixing ratio. Any ratio in the range of 1:1 to 10:1 is contemplated by the disclosure.

The filling gun 75 has an activator, a catalyst, a hardener, or a reducer within a tube or container or reservoir 79 which is injected into the can through a filling head 80. The tube or reservoir is pressurized with activator, much as an aerosol can is pressurized. Existing filling systems have solvents and propellants in the can, and the paint or coating is injected into the can through a filling head. The can then sprays the paint which air dries after application. In contrast, the present invention is used with a can which is already filled with paint, adhesive, resin or solvent and propellant at the aerosol manufacturer.

The gun has a tube housing 82 and a handgrip portion or trigger housing 84. The tube housing 82 is cut away along the side walls 77, 78 to provide easy access for inserting a tube 79 into the tube housing.

Filler head 80 is supported by a groove or semi-circular cutout 86 formed in U-shaped wall 88, which is at an end of side walls 77, 78 of housing 82.

Passing through the housings is a piston rod 94. Although the piston rod 94 is shown as installed in the trigger housing 84, it can be withdrawn out the rearward end of the housing 84 for complete removal. With the piston rod removed, the portions of the gun can be easily disassembled. When the gun is completely assembled, the piston rod 94 passes through central holes 96, 98 in the tube housing wall 89 and the handgrip housing, respectively.

The handle trigger 85 is ergonomically shaped to dismantle in user's hand and is shaped to fit the user's fingers. This configuration provides for a very comfortable, natural gripping tool which, by virtue of its shape, enables the user to hold the handgrip portions 97, 99 in his hand, with less likelihood that the handgrip will slip from its natural position.

The U-shaped opening 86 in the forward wall 88 of the housing 82 is provided to permit the filling head to extend forward from the housing.

The system uses a filling head which has a stem 100 much like the stem of an aerosol can as shown in FIG. 3. The stem does not have a metering slot, however.

The spray head of the aerosol can B is removed to attach the filling head 80 onto the top of the can. The stem 100 of the filling head seals on the valve mounting cup 54, and the filling head pushes down on the valve assembly thereby charging the can through the dip tube 56 to the bottom of the can.

The filling head 80 is described as being used with a female valve, but the filling head can also be used with a male valve as well, and also with any other valve system for an aerosol can without departing from the scope of the present disclosure.

When the activator is pressure filled into the can, the activator or catalyst causes a chemical reaction with the product. The shelf life of the product begins once the product is activated. The shelf life can range from two hours to several days or more. Therefore, the activator should not be added until the time of filling and use of the product, since the product becomes cured quickly and is ready to use. For example, the catalyst should not be added to a paint spray can until the user is ready to spray the automobile or whatever will be sprayed. At the time of application, the hardened or catalyzed paint, adhesive, or resin has a chemical reaction on the application surface and dries on the surface.

For example, a gallon of clear or colored paint would have added to it a quart of activator, resulting in a catalyzed product. A catalyzed product is preferable to use than a non-catalyzed product, since the catalyzed product has better performance characteristics. The paint alone would never dry or cure until the catalyst is added. The same applies to an adhesive, such as a structural urethane adhesive used to glue metal to metal or plastic to metal on cars or trucks. Another application would be SMC resins which would be catalyzed to be used for boat repairs.

Referring again to FIG. 5, the filling head 80 can be of different sizes to accommodate different volumes of material. The filling head is attached to liquid reservoir or tube 79 which holds about 2¼ ounces of catalyst or activator. However, other size reservoirs, such as a 4-ounce reservoir 79 could also be used when the filling head is used with different valve systems. The reservoir 79 has an opening 102 to accommodate the piston rod or plunger 94, which is attached to handle 84. The plunger and reservoir are housed within the housing 82.

Referring now more particularly to FIGS. 5-9, the gun 75 has filler head 80 which is mounted to either a female valve stem or a male valve on the aerosol can which are shown in FIGS. 3 and 4. Slight movement of the filler head by squeezing the gun handle 84 will depress the valve stem 100 sufficiently to open the associated can valve C or D and thus establish communication between the interior of the can and the passage of the filling head. It is essential that a seal be established before the valve of the filler head is open to permit the feed of activator under pressure through the passage.

Figures 6, 6A:
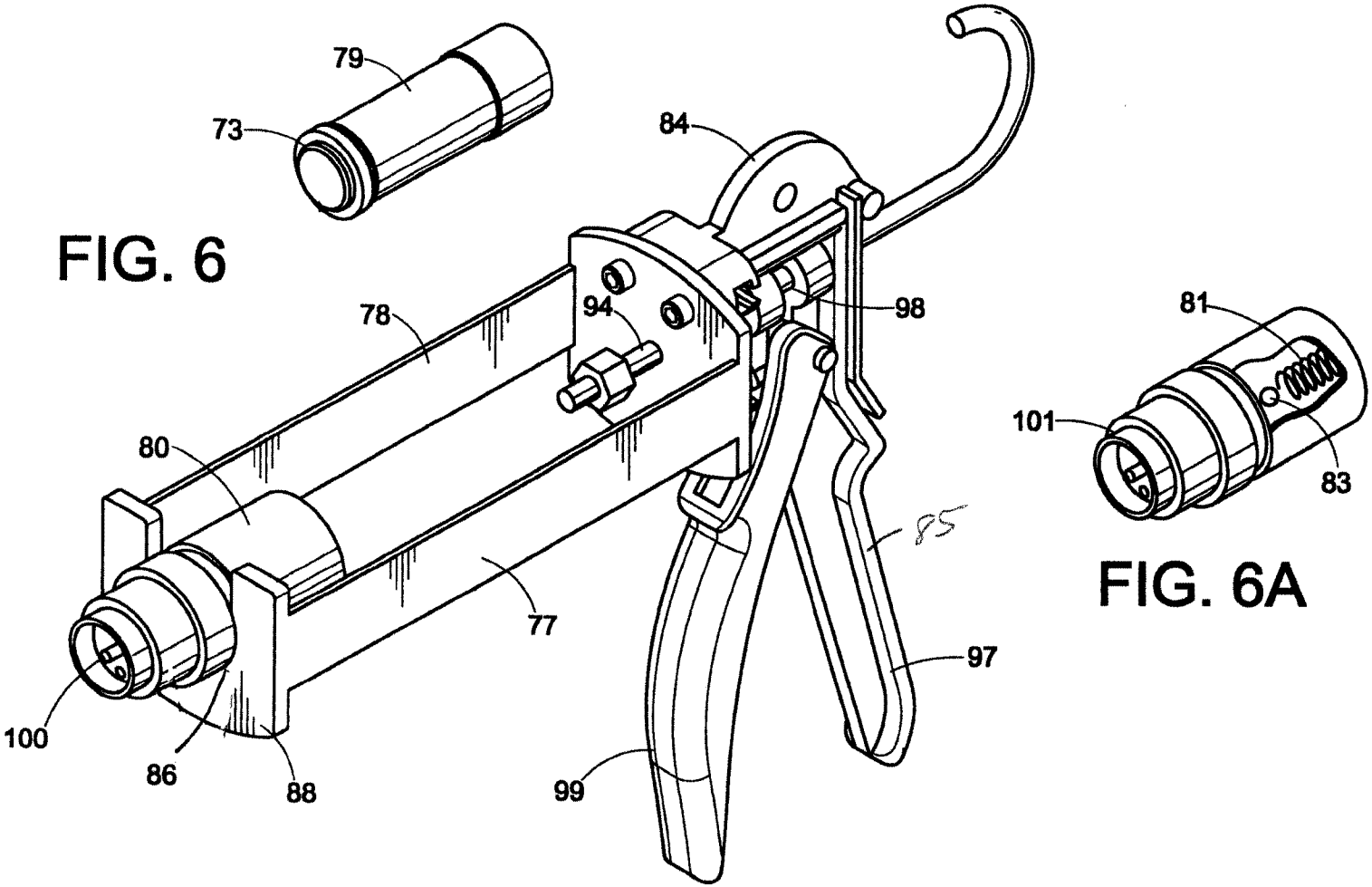
FIG. 6 is an exploded perspective view of the filling gun of FIG. 5.
FIG. 6A is a view of the filling head showing a spring and ball mechanism within the filling head.

Referring now to FIGS. 6 and 6A, trigger 85 of the handle 84 is depressed, thus moving the plunger or piston rod 94 connected to an end of the activator reservoir 79. The reservoir has an O-ring 73 which comes in contact with a surface of the filling head 80 as the reservoir enters an opening of the filling head. Referring to FIG. 6A, the filling head 80 has a spring 81 and ball 83 assembly which are pushed toward end 101 of the filling head as activator is released into the filling head toward stem 100. The stem then depresses a valve assembly C or D on the aerosol can.

As soon as the valve of the can is open, activator under pressure will be fed into the chamber of the can. At the same time, the plunger or piston 94 is pushed by the handle 84 to feed activator from the reservoir 79 into the chamber of the can through the filling head. The pressure of the filling head and reservoir exceeds that of the pressurized aerosol can, thus preventing activator from traveling from the can back into the filling head.

The activator is then fed into the aerosol can, thus creating a mixture within the can such as colored paint, coating, adhesives, fiberglass resins, epoxy, etc. The can is immediately available for spraying a customized paint, adhesive, resin or coating by the user while in the field.

Figure 7:
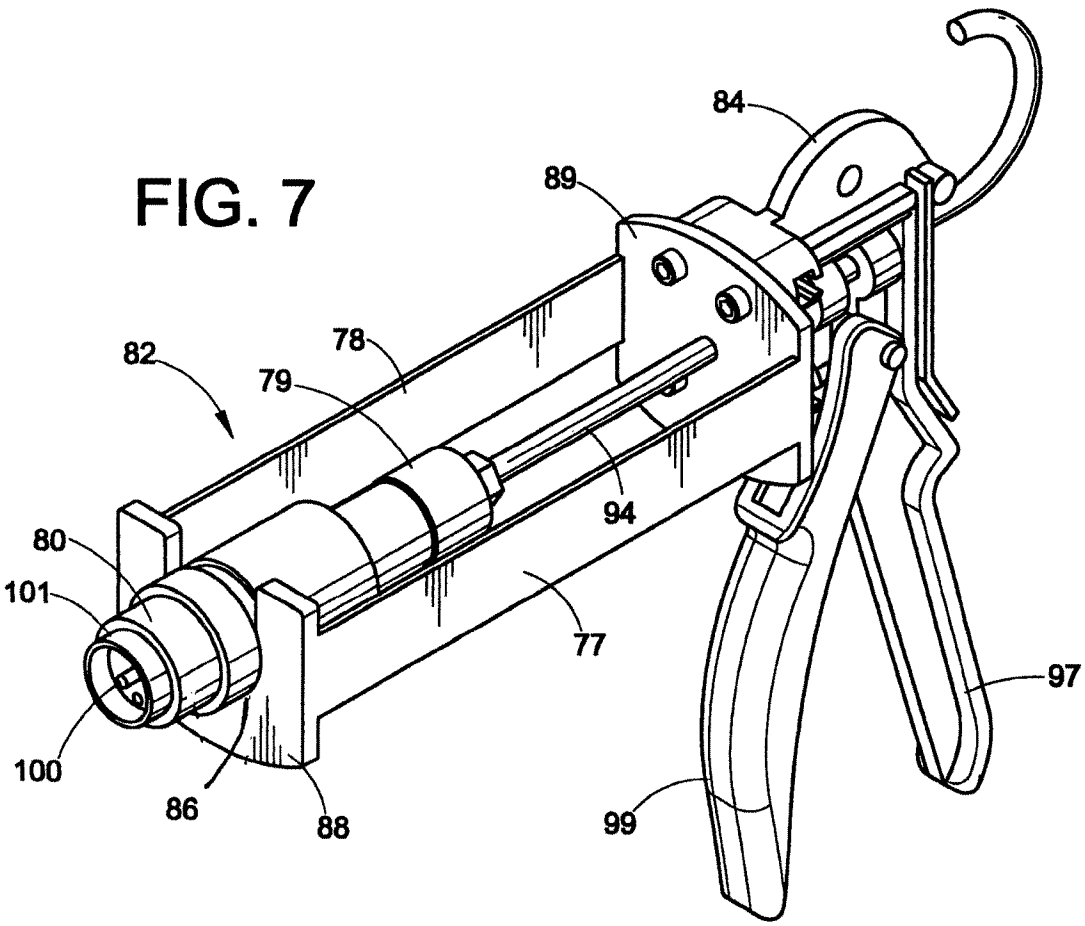
FIG. 7 is a perspective view of the filling gun in a used or depressed configuration.
Figure 8:
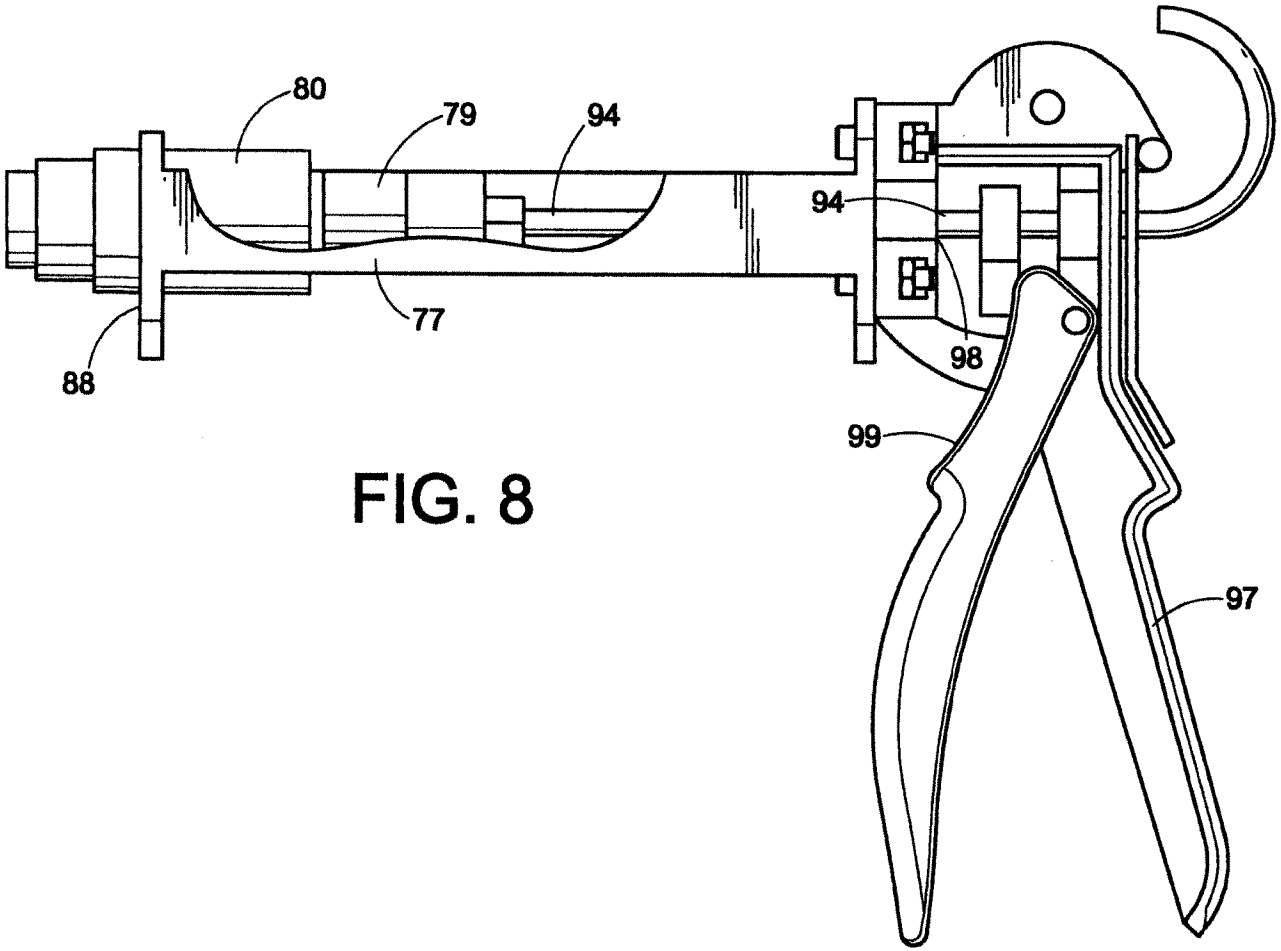
FIG. 8 is a side elevational view of the filling gun in a used or depressed configuration.

The handle is depressed to move the plunger or piston to push the plunger into the reservoir, thus forcing liquid activator into the filling head. The activator then travels through the stem and into the valve assembly of the aerosol can. Referring to FIGS. 7 and 8, the reservoir 79 moves to an in-use position. The stem is pushed down on the mounting cup 54 or 68 of the can. The activator is then pushed through the dip tube 56 or 70 to the bottom of the can. In the present disclosure, the activator supply is poured into bottle, or tube or reservoir 79, such as a one- or two-ounce bottle, which is mounted into the gun. The gun has about a 26 to 1 thrust pressure, which aids in filling the can with activator through the valve. The plunger preferably has a thrust ratio of about 26:1, but the thrust ratio can be 50:1 or other ratios as well, without departing from the scope of the disclosure.

Typically, the aerosol can is placed vertically on a support surface and the filling head is manually pressed downwardly onto the valve assembly which seals the stem 100 onto the valve. However, the filling head can also be used in a horizontal orientation wherein the can is horizontally secured or held and the filling head is laterally pressed into the valve.

Since the gun is transportable, the gun can be easily used in the field, such as body shops, factories, oil rigs, etc. The gun is inexpensive (around $150) in comparison to a pneumatic filling machine (around $3,500). A manual filling machine costs around $500.

Thus, the user can activate the coating in the field at the time of use. For example, the gun can be given to the user with an activator which is injected into the can and results in a specific paint, adhesive, resin or coating within the can for immediate use.

The problem with a previously activated product, such as is made with a filling machine, is that the activator can set up and cure in the can if not used within several hours. Thus, it is preferable to inject the activator just prior to use. Once activated, the coating cures due to the chemical reaction between the activator and paint. After use, the can should be discarded.

Advantages of the filling gun are its low cost, portability, ease in using in the field, such as in body shops, oil rigs, factories, plants, etc.; and ability to be used with an aerosol can having a female or male valve, or any valve system. The filling gun can be used with any product that needs to be catalyzed or activated, such as paints, adhesives, resins, fiberglass or SMC resins, epoxy, etc.

Figure 9:
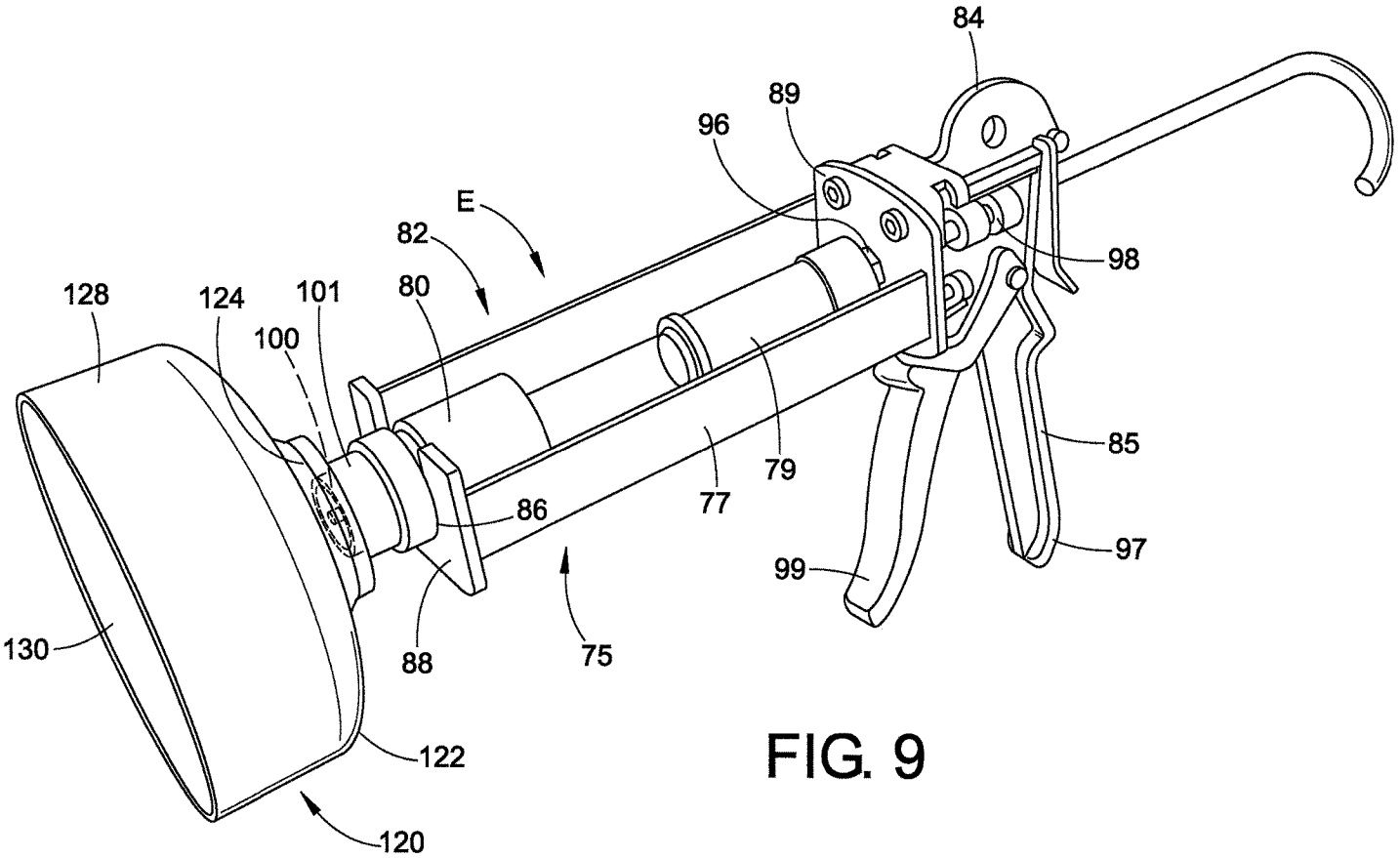
FIG. 9 is a side perspective view of the filling gun with a protective cover mounted thereon in accordance with another aspect of the disclosure.
Figure 10:
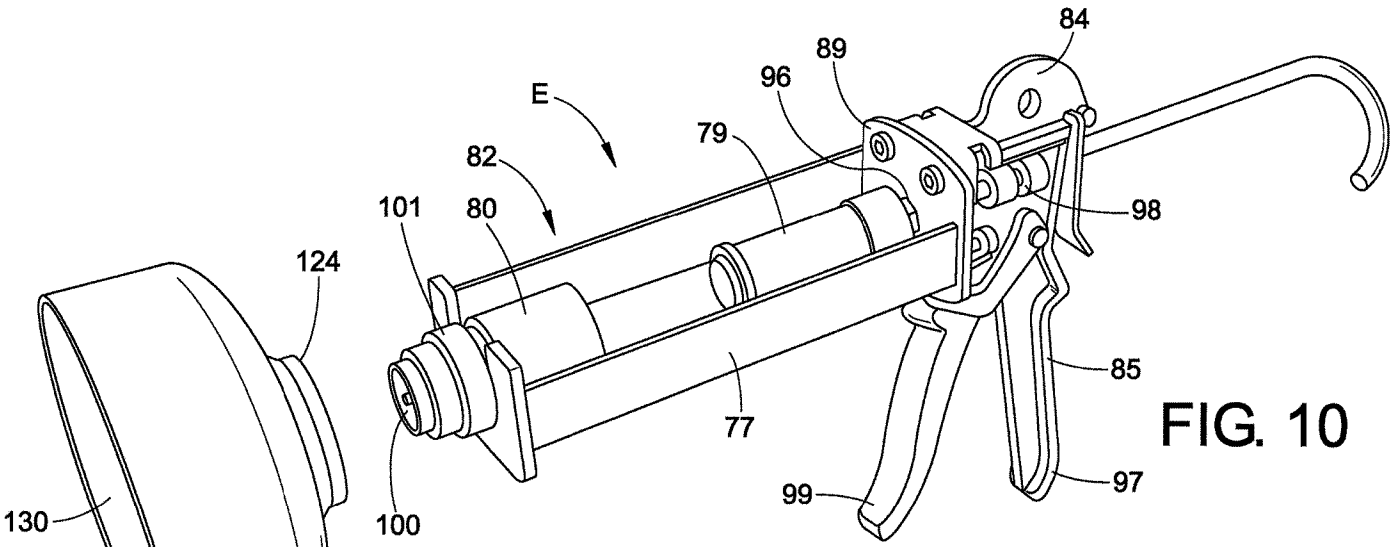
FIG. 10 is a side exploded perspective view of the protective cover and filling head of FIG. 9.
Figure 11:
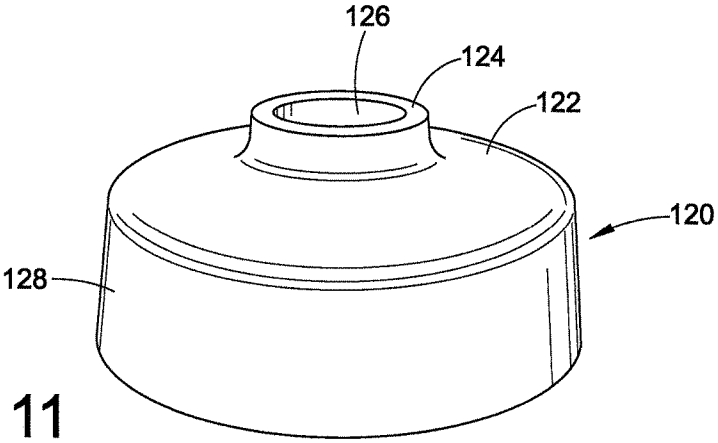
FIG. 11 is a perspective view of the cover of FIG. 9.

Referring now to FIGS. 9, 10, and 11, a filling head gun with a protective cover 120 is shown in accordance with another embodiment of the disclosure. The parts of the assembly that are the same as in FIGS. 5-8 have the same reference numerals. The cover 120 can be made of metal, sturdy plastic or any suitable material. Specifically, the cover 120 has a top or upper surface 122 which preferably has a raised portion or protrusion 124 centrally formed thereon. Within protrusion 124 is a cutout or opening 126 which accommodates filling head 80, particularly, head end portion 101 and stem 100. The opening 126 is configured so that the filling head end portion 101 can at least partially extend into the opening. The cover further has a side wall 128 depending downwardly from upper wall 122 forming an inner cavity 130 therein which substantially surrounds and covers an upper portion of an aerosol can as well as stem 100 and at least a portion of end portion 101 of filling head 80. The cover is preferably friction fit or snapped onto end 101 of filling head. Other ways of securing the cover to the filling head are also contemplated by the disclosure such as fasteners. The cover is preferably mounted to the filling head prior to installing the filling head onto the aerosol can. The cover seals the connection between the aerosol can and the filling head as well as helps prevent any spraying of coating toward the user. Alternately, the cover may also be an integral part of the filling head assembly.

Thus, the cover 120 is provided to protect the user from any spray leaving the filling head or aerosol can and also to minimize any spray of liquid as it leaves the filling head and enters the aerosol can.

Figure 12A:
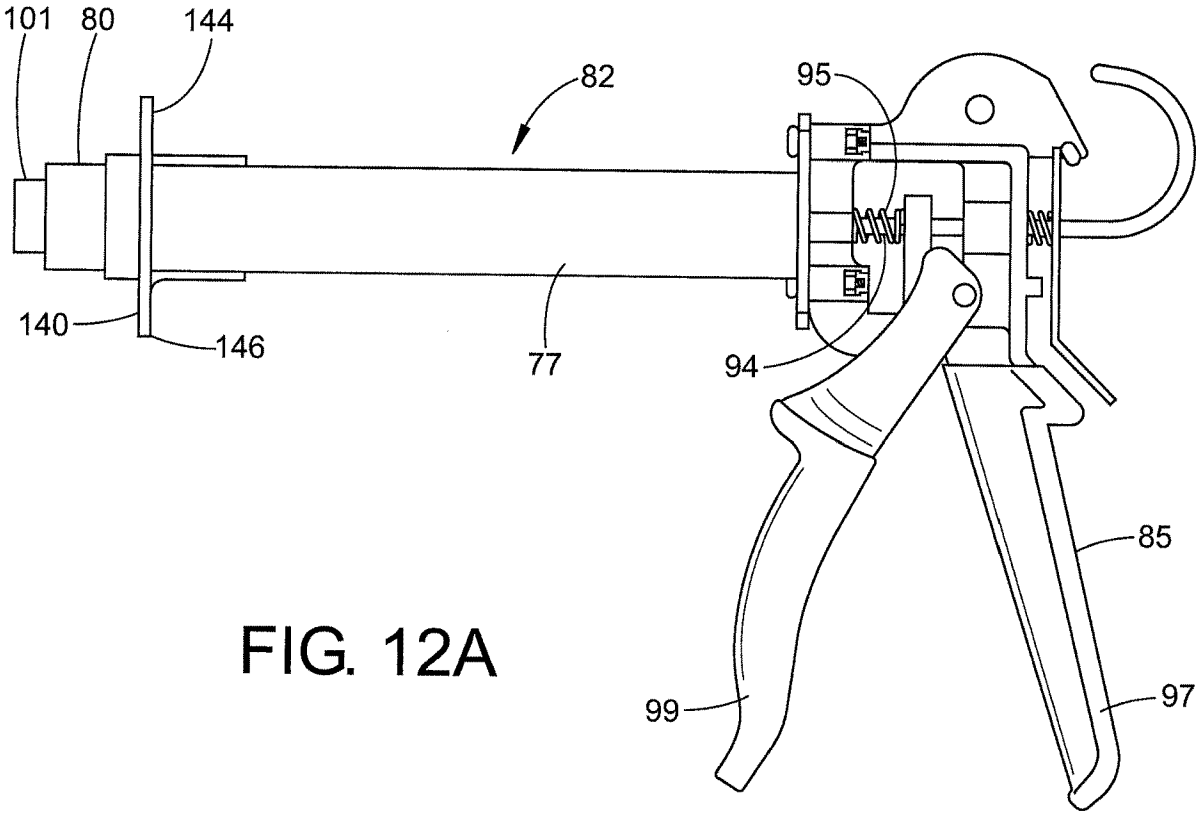
FIG. 12A is a side elevational view of the filling gun with a platform extension in accordance with another embodiment of the disclosure.
Figure 12B:
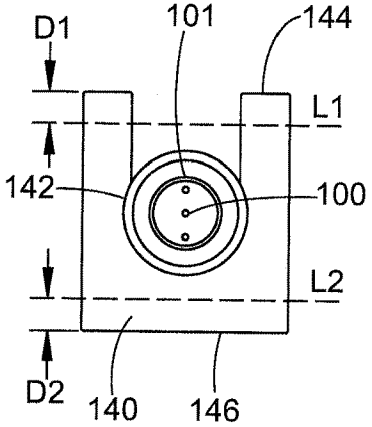
FIG. 12B is a front plan view of the platform extension of FIG. 12A; and, FIG. 13 is a perspective view of the filing gun of FIG. 12A.
Figure 13:
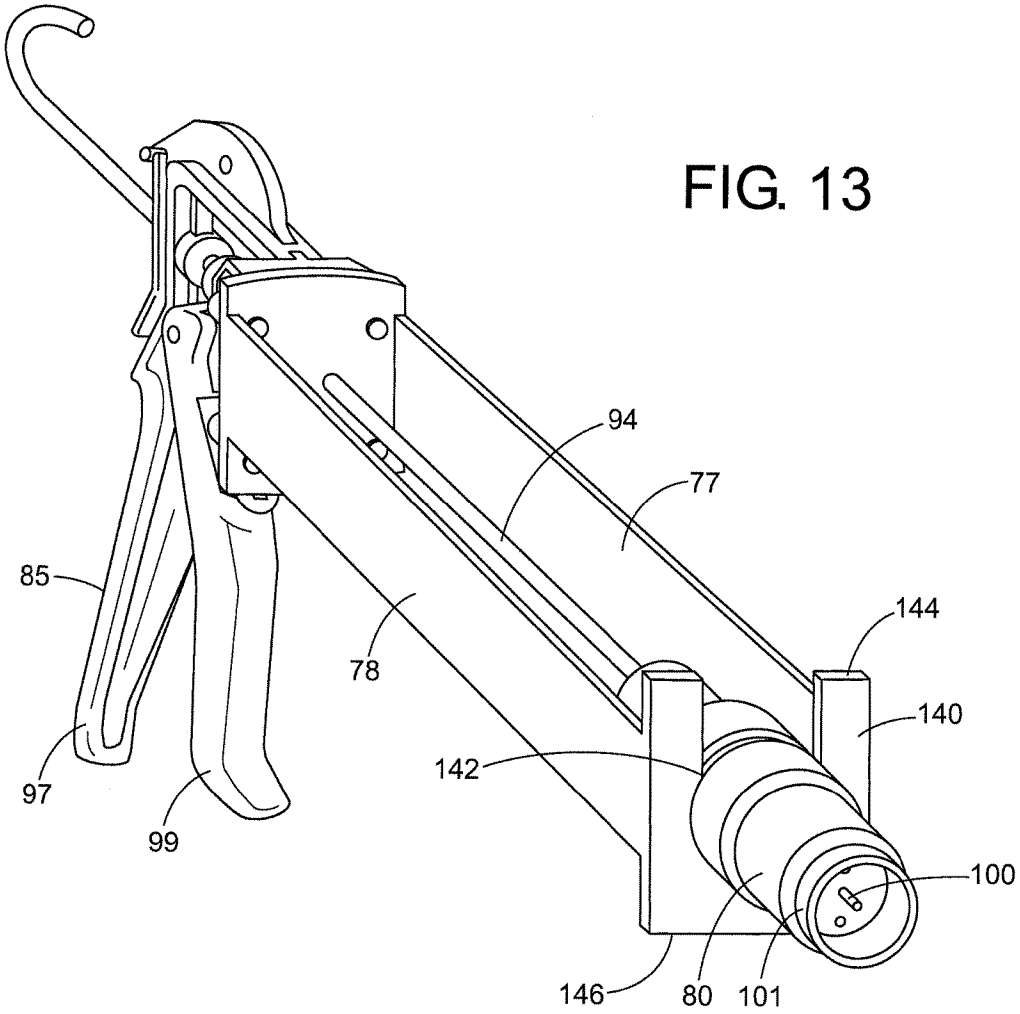

Referring now to FIGS. 12A, 12B and 13, a filling head gun with a platform extension 140 in accordance with another embodiment of the disclosure is shown.

Specifically, the platform extension 140 is used to facilitate holding the front end portion 101 of the tube in place within the filling gun. The platform extension 140 has a planar wall 141 in which a substantially U-shaped cut-out or opening 142 is formed. The opening 142 accommodates the tube portion of filling head 80 including end portion 101 of the filling head. The platform extension may preferably be made of metal or rigid plastic.

Preferably, referring to FIG. 12B, the extension has a top portion edge 144 which extends a distance D1 of about 0.25 inches from a reference line L1 just above the top of the filling head. Similarly, a bottom portion edge 146 extends a distance D2 of about 0.25 inches below a second reference line L2 below the filling head. The top portion edge 144 and bottom portion edge 146 form extensions to be used as foot pedals to aid in the retraction of the piston once fully impressed. That is, the user pushes on top of the extension top edge 144 and/or the bottom edge 146 and pulls on the filling gun to release the piston tool 94 from engagement with the aerosol can mounting cup. The platform extension can be formed as an integral part of housing 82 or can be a separate part attached to the end of the housing by including a fastening means.

The exemplary embodiment has been described with reference to the preferred embodiments. Obviously, modifications and alterations will occur to others upon reading and understanding the preceding detailed description. It is intended that the exemplary embodiment and appended claims be construed as including all such modifications and alterations insofar as they come within the scope thereof.

The invention claimed is:

1. A filling head gun assembly comprising:

a housing;

a pressurized activator;

a reservoir for containing said activator;

a handle assembly connected to said housing;

a filling head attached to said housing; and a plunger, wherein said plunger extends through an opening of said housing and said activator reservoir attached to said plunger, said reservoir is moved into position to contact said filling head via said plunger to feed pressurized activator through said filling head to an associated aerosol can and a protective cover releasably attached to an end of said filling head which provides a seal around said filling head; and wherein said filling head comprises a stem to seal an associated valve mounting cap of said aerosol can and forms a single releasable non-threaded connection to said aerosol can;

wherein said protective cover comprises an upper wall having an opening therethrough for said filling head and a side wall depending downwardly from said upper wall forming an inner cavity which substantially surrounds and covers at least a portion of an end portion of said filling head and said associated aerosol can.

2. The filling head gun assembly of claim 1, wherein said protective cover is made of plastic.

3. The filling head gun assembly of claim 1, wherein said protective cover comprises a raised portion having a central opening therein and wherein said protective cover is releasably attached to an end of said filling head which provides a seal around said filling head.

4. The filling head gun assembly of claim 1, wherein said filling head comprises a ball and spring mechanism used to feed activator into an associated aerosol can.

5. The filling head gun assembly of claim 1, wherein said plunger comprises a piston rod.

6. The filling head gun assembly of claim 1, wherein said activator reservoir comprises an O-ring for engaging said filling head.

7. The filling head gun assembly of claim 1, wherein said handle assembly comprises a trigger which is depressed to move said plunger and said reservoir into contact with said filling head.

8. The filling head gun assembly of claim 1, wherein said activator reservoir contains one of a catalyst, an activator, a hardener and a reducer.

9. The filling head gun assembly of claim 1, wherein said reservoir accommodates two and one-quarter ounces of activator.

10. The filling head gun assembly of claim 1, wherein said reservoir accommodates four ounces of activator.

11. A filling head and aerosol can assembly comprising:

an aerosol can having a body having a valve and dip tube, propellant, a coating, and a valve mounting cup;

a filling head assembly comprising:

a housing;

a pressurized activator;

a reservoir for containing said activator;

a handle connected to said housing;

a filling head attached to said housing via a piston rod;

a tube containing said pressurized activator which is connected to said piston rod wherein said handle is depressed to move said piston rod to feed said pressurized activator through said tube into said filling head; and wherein said filling head is mounted onto said valve mounting cup, and a stem of said filling head seals on said valve mounting cup of said aerosol can;

said filling head assembly comprises a protective cover which mounts to an end of said filling head and provides a seal of said filling head and said aerosol can wherein said protective cover comprises an upper wall having an opening therethrough for said filling head and a side wall depending downwardly from said upper wall forming an inner cavity which substantially surrounds and covers at least a portion of an end portion of said filling head and said aerosol can; and said filling head further comprises an extension member which facilitates retraction of said piston rod from said aerosol can.

12. The filling head gun assembly of claim 11, wherein said protective cover is made of plastic.

13. The filling head gun assembly of claim 11, wherein said protective cover comprises a raised portion having a central opening therein and wherein said cover is releasably attached to an end of said filling head which provides a seal around said filling head.

14. The filling head and aerosol can assembly of claim 11, wherein said filling head injects said pressurized activator into said aerosol can through said stem.

15. The filling head and aerosol can assembly of claim 11, wherein said extension member comprises a substantially u-shaped opening.

16. The filling head and aerosol can assembly of claim 15, wherein said extension member comprises an upper edge and a lower edge which are extended above and below said filling head to facilitating retraction of said piston used.

* * * * *